US006035904A

United States Patent [19]

Beau et al.

[11] Patent Number: 6,035,904

[45] Date of Patent: Mar. 14, 2000

[54] METERING AND FILLING DEVICE, IN PARTICULAR FOR ARTIFICIAL INSEMINATION OF POULTRY

[75] Inventors: Christian Beau, Voisins-le-Bretonneux; Jean-Pierre Brillard, Joue-les-Tours, both of France

[73] Assignee: Instruments de Medecine Veterinaire, L'Aigle, France

[21] Appl. No.: 08/817,902

[22] PCT Filed: Jan. 4, 1996

[86] PCT No.: PCT/FR96/00016

§ 371 Date: Apr. 25, 1997

§ 102(e) Date: Apr. 25, 1997

[87] PCT Pub. No.: WO97/24999

PCT Pub. Date: Jul. 17, 1997

[30] Foreign Application Priority Data

Nov. 23, 1994 [FR] France ..... 94 14012

[51] Int. Cl.[7] ..... B65B 1/04

[52] U.S. Cl. ..... 141/130; 141/18

[58] Field of Search ..... 141/2, 18, 173, 141/130, 98

[56] References Cited

U.S. PATENT DOCUMENTS 3,880,210 4/1975 Randolf et al. ..... 141/175

4,478,261 10/1984 Cassou et al. ..... 141/2

4,702,679 10/1987 Malbec ..... 417/475

FOREIGN PATENT DOCUMENTS 0041267 12/1983 European Pat. Off. .

*Primary Examiner*—Steven O. Douglas

*Attorney, Agent, or Firm*—Morgan & Finnegan, L.L.P.

[57] ABSTRACT

The disclosure concerns an automatic machine for metering and filling, for example volumes of animal semen, in any packaging member, regardless of its diameter and the material from which it is made (straws, glass or plastics material catheters, all types of flask, etc). Essentially intended for artificial insemination of poultry, for example turkeys, this device nevertheless has an extremely wide range of application. For example, using a peristaltic cassette (12) (described, for example, in U.S. Pat. No. 4,702,679 filed by MALBEC), under the control of a digital controller, the machine enables small volumes of liquid to be dispensed with the greatest possible accuracy and very high rates of artificial insemination to be maintained. The objectives of the invention include a device for precise and fast metering of any fluid, primarily for use in animal husbandry and research laboratories.

18 Claims, 7 Drawing Sheets

METERING AND FILLING DEVICE, IN PARTICULAR FOR ARTIFICIAL INSEMINATION OF POULTRY

BACKGROUND OF THE INVENTION

The present invention concerns an automatic metering and filling machine, in particular for volumes of animal semen packaged in any kind of packaging member (by way of non-limiting example: cannulas, straws, catheters, tubes, flasks, etc) regardless of their diameter and of the material from which they are made. This device is more particularly, although not exclusively, suitable for insemination of poultry, such as turkeys, for example.

The equipment traditionally employed for artificial insemination of poultry, for example, conforms to various criteria allowing for the anatomical, physiological and economic peculiarities of these species. Four of these criteria are crucial in the case of industrial applications. These absolutely essential criteria are as follows:

1—dispensing, with the greatest possible accuracy, small volumes of pure or diluted sperm, for example;

2—supporting very high rates of artificial insemination (several hundred inseminations per hour, by way of non-limiting example, between 500 and 800 inseminations per hour, in turkeys, depending on the number of inseminators);

3—reducing or even eliminating the risk of horizontal (i.e. female to female) transmission of contaminating agents (for example Mycoplasms or Salmonella);

4—easy and fast disinfection.

The construction of automatic metering and filling machines commercially available at this time does not satisfy all these requirements simultaneously. Although this equipment in all cases satisfies the last two of the specifications mentioned above, this is not so in respect of the first two. The equipment is designed on the principle of distribution using a syringe or an air suction system. The use of a syringe generally limits the speed with which doses can be dispensed and the use of an air suction system does not allow accurate metering of the liquid substance to be introduced into the interior of a cannula, for example. Consequently, and regardless of their qualities, this equipment is either very accurate and rather slow or fairly fast and somewhat inaccurate. What is more, most of this equipment is generally relatively costly and must in some cases be associated with a compressor, which does not facilitate the work of inseminators moving amongst animals or in poultry batteries, for example.

A machine for filling artificial insemination straws for poultry, for example, is described by the applicants of the present patent in Pat. Nos. 2,500,296 and 2,513,110. The invention has many advantages over the above machine, which is commercially available and in use at this time.

The existing machine utilizes a piston pump, unlike the invention, which uses a peristaltic cassette (as described, for example, in European patent application No. 81104214.2 (U.S. Pat. No. 4,702,679) filed by MALBEC) under the control of a digital controller. Accordingly, the invention removes all of the drawbacks mentioned in connection with the existing equipment.

The existing machine uses a device for clamping a tube by means of three separate members in metering and filling cannulas or any other packaging members with a liquid of any kind. The advantages of the invention include a compact system based on a peristaltic cassette containing a preferably flexible tube and rollers. (See U.S. Pat. No. 4,702,679 mentioned above. The pressure applied to the tube by said rollers delivers a dose. This principle is therefore substituted for the radial clamping members of the machine currently used.

Moreover, the central member of the existing machine having a fixed dimension, the dose is adjusted by limiting the travel of the central member, which sometimes leads to some inaccuracy in respect of the volume of the dose delivered. The adjustment is effected by limiting the travel of the central member by means of a screw and a key, which wastes a certain amount of the operator's time. In the new machine, on the other hand, the subject matter of the present patent, the adjustment is carried out by pressing on two buttons, preferably pushbuttons, either in a pulsed mode (fraction of a dose, for example) or in a continuous mode (passing a dose of 40 microliters to 50 microliters, for example). The dose is defined by a number of turns or of fractions of turns of the peristaltic cassette. Said number of turns or fractions of turns of the peristaltic cassette being controlled by a position control loop in turn controlled by a microprocessor, the dose delivered is therefore more accurate.

Turning to the function of priming the peristaltic cassette, when using the existing machine it is possible to observe the loss of some of the semen intended to be packaged in the interior of a cannula, for example, and contained within the feed tube. This is due to the configuration of the filler needle, which plugs in rather than clipping on, like that of the invention. It therefore does not benefit from a mounting device as practical and as perfected as that of the invention. Removing the needle requires the operator to clamp the feed tube, causing some loss of the fluid to be packaged and unpriming of the peristaltic cassette. Moreover, said tube must be manually inserted by the operator between the three obturator members of the cassette mentioned above, which frequently stretches the tube and consequently varies the volume of the dose delivered.

SUMMARY OF THE INVENTION

Unlike the existing machine, the manner in which the invention has been conceived enables the operator to have a perfect view of all the controls of the machine, which facilitates correct execution of operations.

Turning to the system for transferring the cannulas and/or any other packaging members, the invention once again has an undoubted advantage over the machine as currently marketed by the applicants, among others. From now on, to transfer the cannulas from the filling station to the extraction station, for example, it is no longer necessary to use a friction and mechanical indexing drum driving system, as previously. This system has the disadvantage of being costly and, more importantly, bulky. The configuration of the new machine, the subject matter of the invention, does not require any plunger as in the existing machine for placing it in the extraction position. The drum enabling transfer of the cannulas to the filling and subsequently extraction stations, for example, is actuated by a rotary electromagnet having two positions: filling station—extraction station.

The object of the invention is essentially to overcome the drawbacks described hereinabove, by proposing a new automatic device for metering and filling cannulas or any other packaging members (straws, tubes, flasks, etc, whether of glass or of plastics material, and regardless of their respective diameter) with animal semen, for example. This lightweight, portable and easy to use device comprises on the one hand a removable rotary peristaltic cassette (described, for example, in European patent No. 811 042

142) that is re-usable or discardable, adapted to be calibrated in accordance with the viscosity of the animal semen, for example, intended to be packaged in cannulas, for example, self-centering with three rollers, with a non-pulsed flow, actuated by a direct current motor with no gearbox and no brake, and controlled by a microcontroller, and on the other hand a system for dispensing and filling the packaging members with the dose of semen delivered by the peristaltic cassette.

The device of the invention is preferably made up of two units. One of these units constitutes a box that is easy to clean and is sealed against splashed and/or running liquids. This box contains the controls and the operating logic of the device, i.e. the peristaltic cassette drive system, the peristaltic cassette control electronic circuits, the power supply unit of the device, the electromechanical members for transferring and filling cannulas, for example, and the electronic control circuits of these transfer and filling members. The other unit, referred to herein as the packaging member transfer and positioning device, is designed to feed cannulas and/or any other packaging members (regardless of their diameter) and to transfer these packaging members from the filling station to the extraction station. The packaging member transfer and positioning device is easy and quick to demount, without tools, and can be cleaned in order to conform with sanitary conditions of use. Moreover, it can be adapted to suit the different configurations of the packaging members that are used to contain animal semen, for example. Thus the device of the invention is not limited to the use of cannulas, but can be used in connection with any packaging member regardless of its diameter and the material from which it is made.

This metering and filling device has many benefits and features. One of its advantages is that it delivers very accurate doses, despite a very high rate of metering and filling (by way of non-limiting example, the rate of metering and filling can be in excess of 2000 packaging elements, for example cannulas, per hour), and regardless of the liquid substances to be packaged and the viscosity of these substances. By way of non-limiting example, this device delivers accurately doses varying between 35 microliters and 100 microliters, in increments of 1 microliter. Moreover, the accuracy of the peristaltic cassette is greater than the variability of the liquid dispensed, in the case of animal semen, regardless of the type of dilutant used and/or the rate of dilution. The accuracy of the volume of the dose delivered depends on a position control loop controlling the rotation of the peristaltic cassette. This loop is controlled by a microcontroller. The dose obtained is proportional to the number of turns or fractions of turns effected by the peristaltic cassette. The number of doses dispensed can be read off from a light-emitting diode digital display. The doses are adjusted by manual action on two buttons, preferably pushbuttons, on the one hand in a pulsed mode and on the other hand in a continuous mode with increasing speed. The peristaltic cassette (European patent No. 811 042 142) is primed in a few seconds, without loss of semen, preferably by manual action, for example on a pushbutton. The transfer of the cannulas, for example, from where they are housed, generally a hopper, to the filling station and thereafter to the extraction station is achieved by means of an inclined chute and a rotary drum actuated by an electromagnet. The essential benefit of the rotary drum is that it is not necessary to use any mechanical indexing system or any other position indexing system. Each of the cannulas, for example, is filled by a needle that travels in a straight line and is also actuated by an electromagnet. This needle is at one end of a tube connected to the peristaltic cassette (patent No. 811 042 142) and is accommodated in a removable unit, among other things to prevent any contact between the needle and the fingers of the operator during operations to mount or to demount the needle unit. The operator can easily mount it on its support and demount it without using any tools. Neither mounting nor demounting of the needle unit unprimes the peristaltic cassette. One end of the needle is preferably rounded so as to avoid injuring the user during mounting, demounting and priming. The number of packaging members filled is automatically indicated on a light-emitting diode digital display. This metering and filling device also has the advantage of being equally convenient for right-handed and left-handed persons.

BRIEF DESCRIPTION OF THE DRAWINGS

Other characteristics and advantages of the invention will emerge from the following description given by way of non-limiting example and with reference to the accompanying photographs, in which.

DETAILED DESCRIPTION OF THE INVENTION

Figure 1:
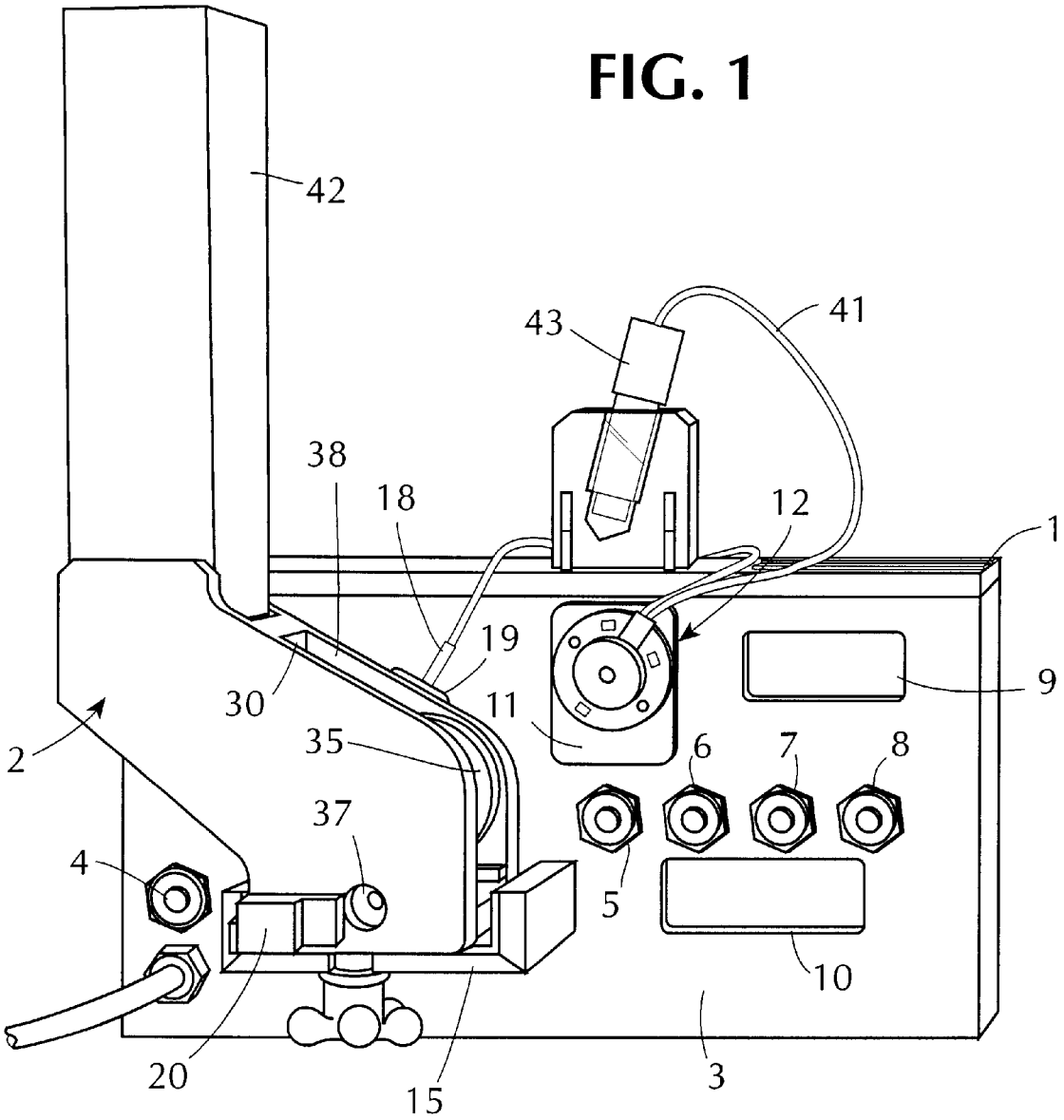
FIG. 1 is a perspective view of the invention.
Figure 2:
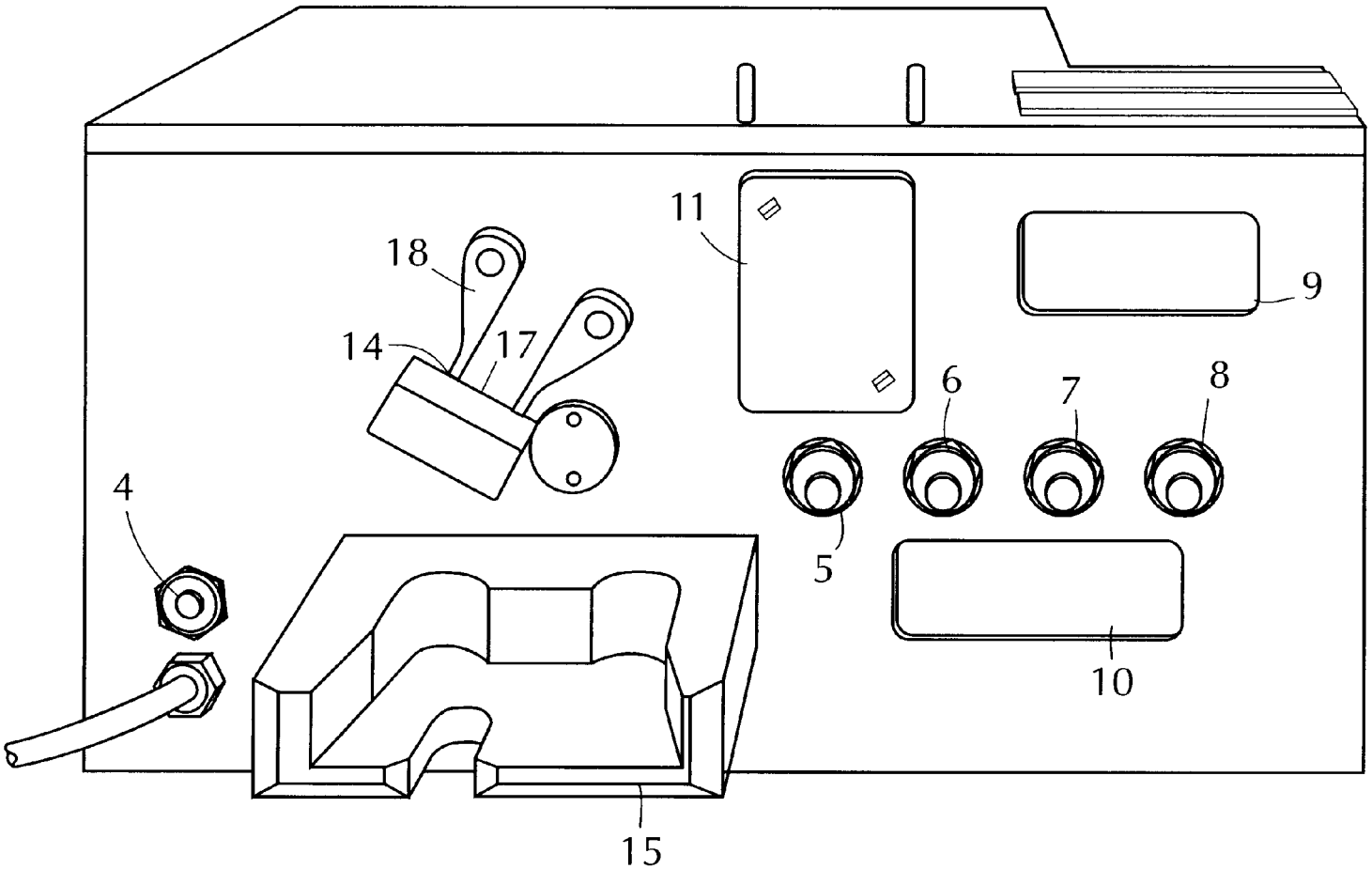
FIG. 2 is a front view without the packaging member transfer and positioning device shown in FIG. 1.
Figure 3:
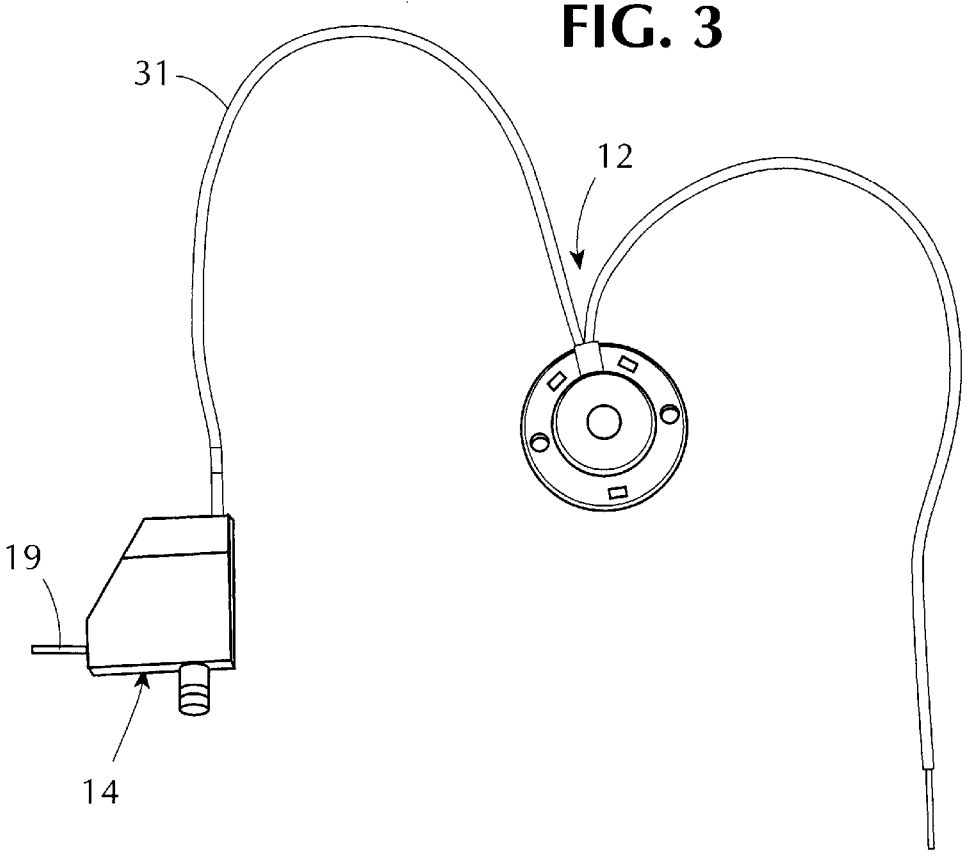
FIG. 3 is a view of the peristaltic cassette (previously mentioned European patent, for example) shown in FIG. 1.

The machine shown preferably comprises two units, as shown in FIG. 1: a unit (1) sealed against splashed and running liquids and a unit (2) referred to herein as the packaging member (for example, but not exclusively, cannula) transfer and positioning device.

On the front face (3) of the unit (1) sealed against splashed and running liquids there are an on/off switch (4); a button (5) for priming a peristaltic cassette (12) (previously mentioned European patent, for example); a button (6) for calibrating said peristaltic cassette (12); the two buttons (7) and (8) for adjusting the dose, the digital display (9) showing on the one hand the calibration value of the cassette (12) (previously mentioned European patent) according to the viscosity of the fluid to be metered and on the other hand the volume of the dose to be delivered; the digital display (10) showing the number of cannulas, for example, filled; the clip-on base (11) of the peristaltic cassette (12) (described in the previously mentioned European patent); the clip-on base (13) of the needle unit (14), into which the filler needle (19) is consequently inserted; the support (15) for fixing the packaging member transfer and positioning device (2), preferably equipped with a positional return counterweight (40); the means (16) for driving the drum (35) of the packaging member transfer and positioning device (2); the means (17)

for driving the disentangling roller (32) of the packaging member transfer and positioning device (2); the guide (18) for fitting the needle unit (14); the inductive sensor (20) for controlling the cycle of the packaging members, for example cannulas (transfer of the cannulas to the filling station, metering of the volume of sperm, for example to be packaged in the cannulas, filling of said cannulas).

The peristaltic cassette (12) (described, for example, in the previously mentioned European patent) is used in association with a preferably plastics material flexible tube (31) crimped inside said cassette (12). One end of this tube (31) dips into the reservoir (43) containing the animal semen, for example, to be packaged inside the cannulas, for example, while the filling needle (19) is inserted at the other end. As shown in FIG. 1, the container (43) is preferably, but not exclusively, placed on the top face of the invention. The accuracy of the dose delivered depends on the inside diameter, and also on the outside diameter of the tube (31), from the material from which it is made and from its hardness. These parameters varying from one cassette (12) (cassette described, for example, in the previously mentioned European patent) to another, each of them is calibrated in terms of flowrate. Thus each cassette (12) is assigned a calibration value corresponding to a dimensionless number within a limited range of 40–180 (these values are given by way of non-limiting illustrative example only) corresponding to the various adjustments of the cassette (12) (cassette described in the previously mentioned European patent filed by MALBEC) in accordance with the viscosity of the product to be metered. The metering and filling device may be equipped with a plurality of peristaltic cassettes (12) in the context of a one-off or continuous multiple filling operation. All that is required is to adapt the configuration of the device accordingly.

The unit (1) sealed against splashed and running liquids houses a control printed circuit (21) for the peristaltic cassette (12); a dose and calibration display printed circuit (22); a device power supply and control printed circuit (23); a printed circuit (24) for the display of the number of cannulas or any other packaging members filled; a drive motor (25) using pulse width modulation control to obtain a variable speed (a motor of this kind and its control system are well known to those skilled in the art and for this reason do not need to be described in more detail) and an incremental encoder (26) for encoding the position of the peristaltic cassette (12). A gearmotor (27) driving the disentangling roller (32) of the packaging member transfer and positioning device (2); an electromagnet (28) for driving a drum (35) of the packaging member transfer and positioning device (2); an electromagnet (29) for driving the filler needle (19); a position loop for delivering accurately the volume of liquid required by the inseminator. This position loop is controlled by a microcontroller. For each of the doses delivered, the loop compares the number of encoder increments effected with the theoretical number of encoder increments.

The absence of any mechanical speed reducing means between the motor (25) and the peristaltic cassette (12) eliminates the problems of efficiency, inertia, play and wear that compromise accurate positioning.

To facilitate any maintenance operations that may be required, the printed circuit boards (21) (23) are easily removable. They are fixed by manually locked board guides that do not require the use of any tools. The wiring of the machine is effected by means of manual plug-in connectors. No tools are required for plugging in or unplugging these.

Figure 6:
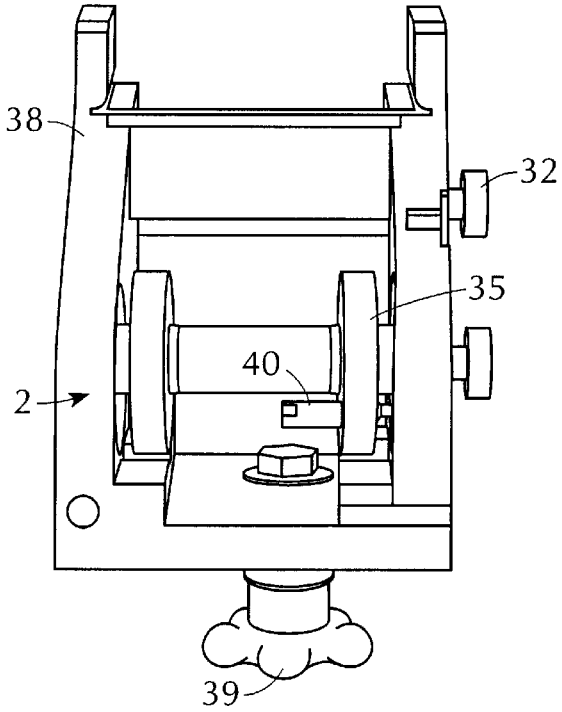
FIG. 6 is a view of the packaging member transfer and positioning device shown in FIG. 1, but as seen in the direction of movement of the packaging members, for example cannulas.
Figure 4:
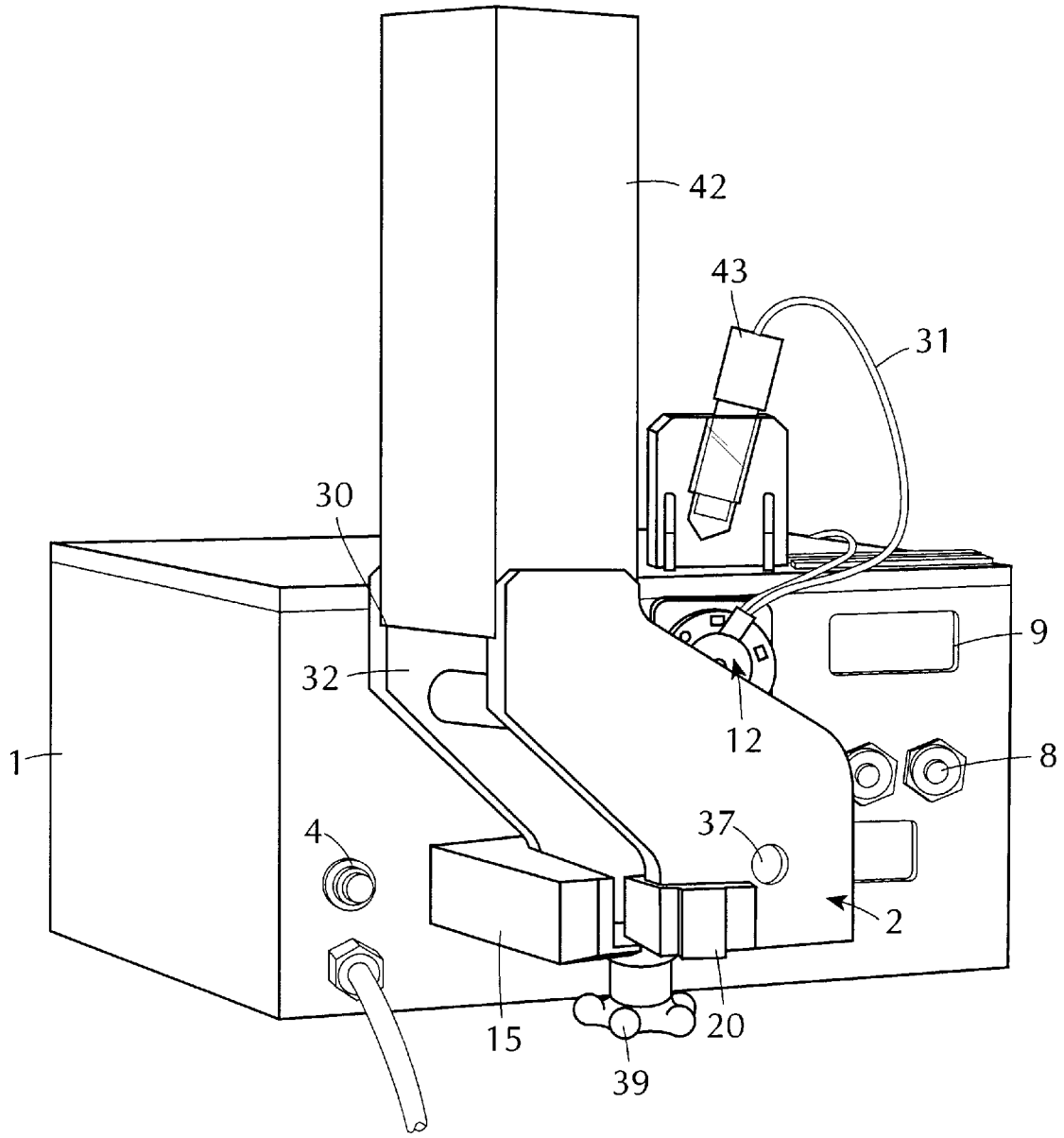
FIG. 4 is another perspective view of the invention shown in FIG. 1, FIGS. 5*a* and 5*b* are respectively a front view and a profile view of the packaging member transfer and positioning device shown in FIG. 1.
Figure 5A:
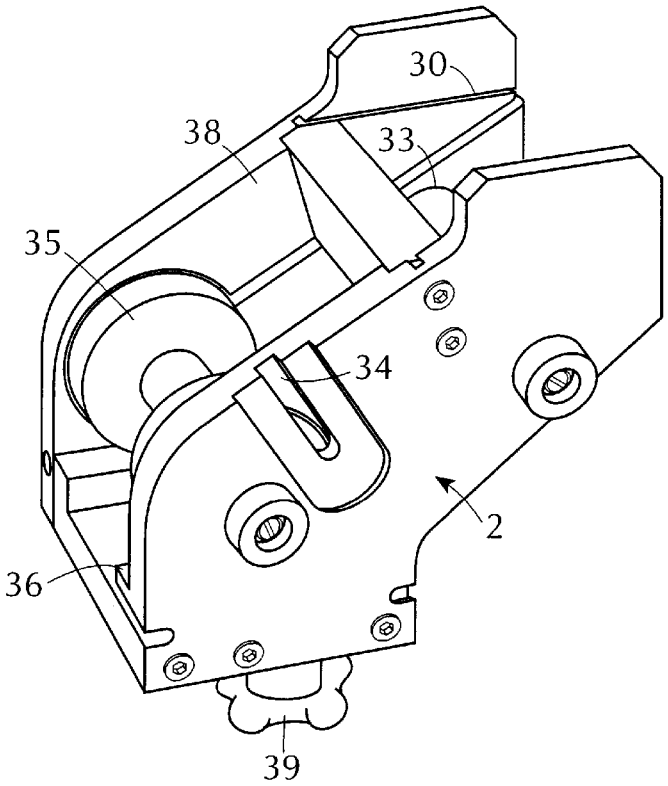
Figure 5B:
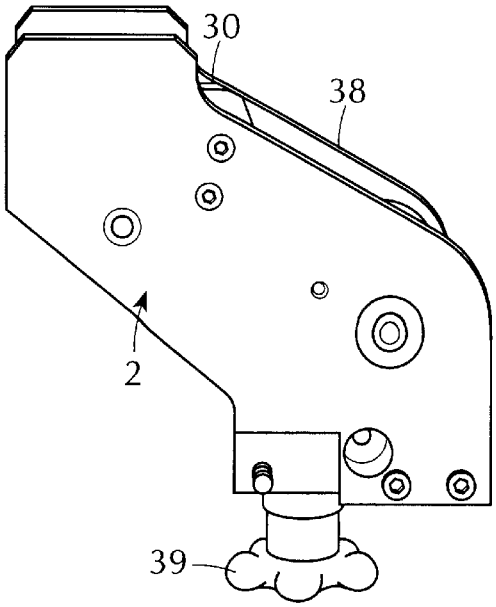
Figure 7:
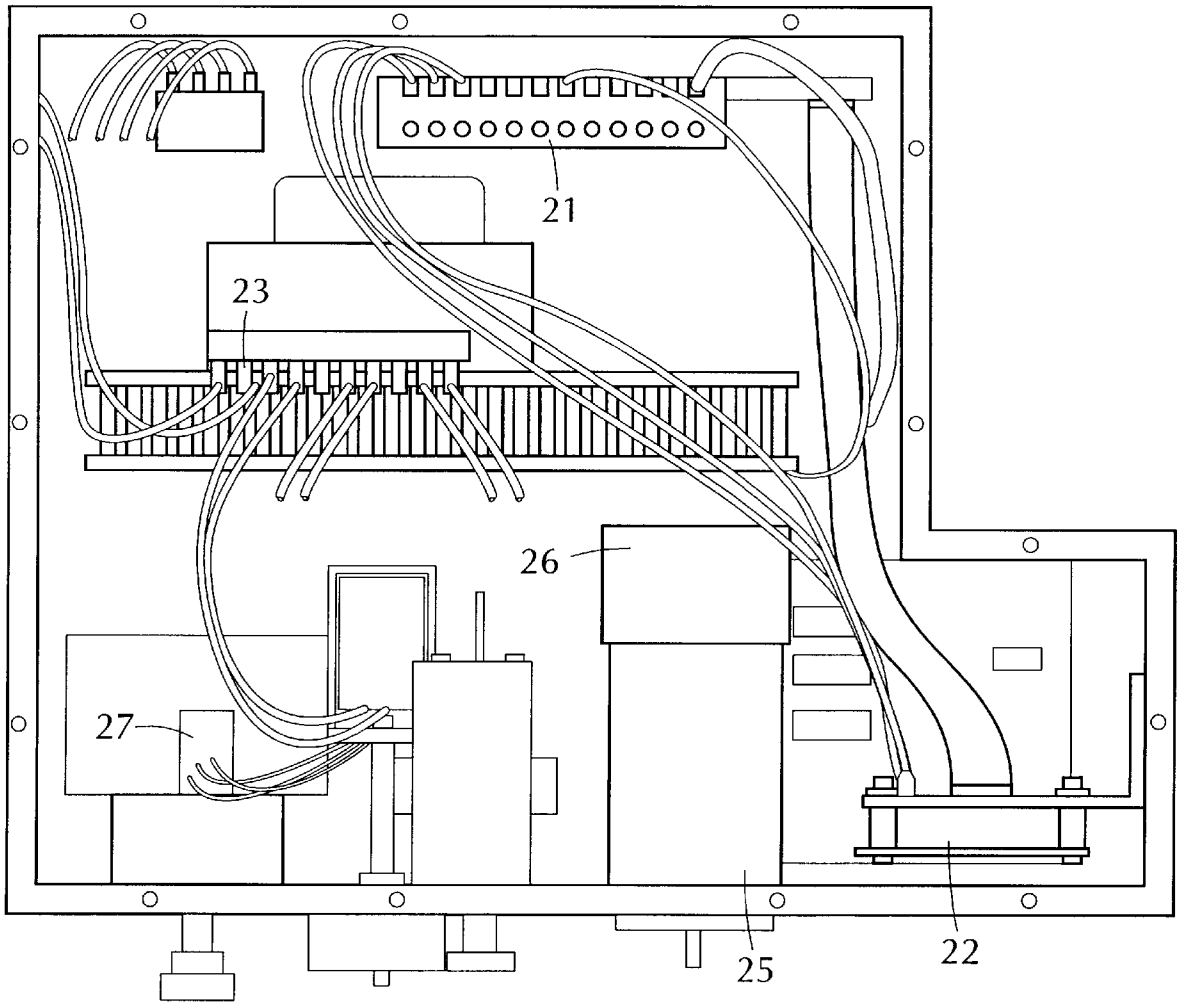
FIG. 7 shows a top view of the control members and of the operating logic of the invention.
Figure 8:
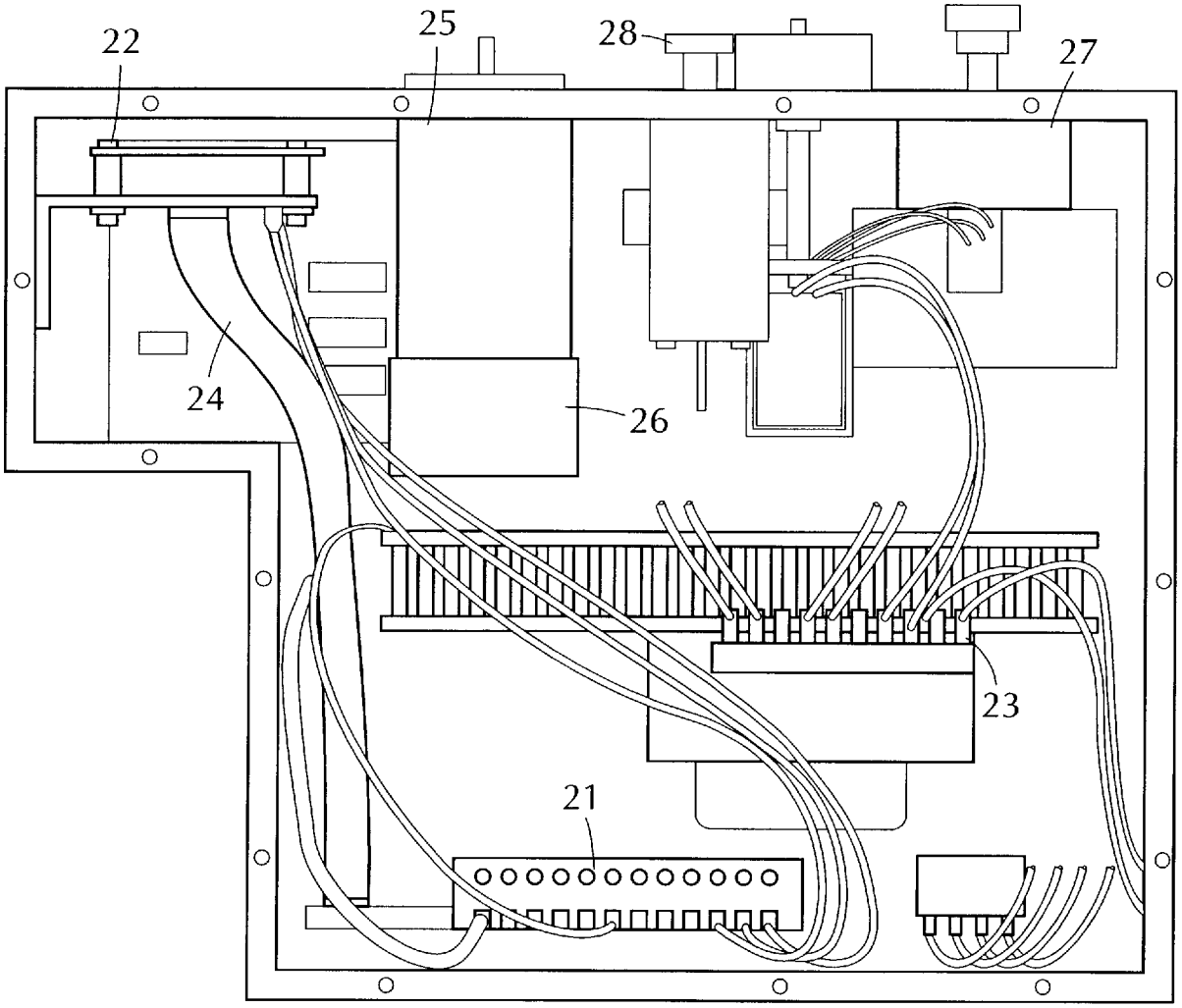
FIG. 8 is a perspective view of the same members as FIG. 7.

As can be seen in FIG. 1, the device of the invention also includes a packaging member transfer and positioning device (2) that is preferably removable in order to facilitate cleaning it, given the sanitary standards that have to be complied with. The packaging element, for example, but not exclusively, cannula, transfer and positioning device (2) comprises a slide (30) for fixing a hopper (42) from which the cannulas, for example, are fed; a roller (32) for disentangling said cannulas, as shown in FIG. 5*a*, in order to prevent any jamming of the cannulas or any other packaging members; a chute (33) for transferring the cannulas, for example (FIG. 6) from the interior of the hopper (42) to the filling station (34); a drum (35) (FIGS. 5*a* and 6) for transferring the cannulas, for example, from the filling station to the extraction station (36); an orifice (37) for supporting a system for handling the cannulas or any other packaging members (FIGS. 5*a* and 6); a preferably transparent cover (38) protecting the packaging member transfer area; a system (39) for locking the packaging member transfer and positioning device (2) to the unit (1) sealed against splashed and running liquids. After demounting said packaging member transfer and positioning device (2), the disentangling roller (32) is driven by automatic meshing with no manual intervention. It is not necessary to position the disentangling roller opposite its drive means (17). Moreover, the inductive sensor (20) for controlling the cycle previously described has a base (42) resting on the slide (30) for fixing the packaging member transfer and positioning device (2) when said device is demounted.

It follows from the foregoing description and from the elements of operation described only in a general manner that the operator proceeds in the following manner: The operator introduces one or more cannulas or other packaging member for animal semen, for example, into the interior of the hopper (42) or any alternative means of storage of packaging members and then places the storage tank (43) of liquid at the required location, presses the on/off switch (4), then presses the calibration button (6) to calibrate the machine to suit the peristaltic cassette (12) (described by MALBEC, for example, in the previously mentioned European patent) and the viscosity of the product. The calibration of the machine corresponds to the following formula: machine calibration=calibration of the peristaltic cassette (12) (dimensionless number between 40 and 180, for example, multiplied by a correction coefficient, for example 1.05, corresponding to the viscosity of the liquid to be metered). This number can be set by means of the buttons (7) and (8) for adjusting the dose. When the calibration has been recorded, the user can adjust the dose by means of said buttons (7) and (8) in a range varying from 35 microliters to 100 microliters, for example (this is a purely illustrative and therefore non-limiting example). Each time it is switched on, the machine holds in memory and uses by default the calibration and metering values previously programmed. If necessary, the operator then positions the filling needle (19) on top of the storage tank and primes the peristaltic cassette (12) by pressing the priming button (5). When the priming has been done, the operator fits the needle unit (14) to the clip-on base (13) with the assistance of the guide (18) and starts the metering and filling cycle by placing the system for extracting the cannulas, for example, in the support orifice (37). Said cycle therefore begins as soon as the operator retracts the system (40) for handling the cannulas or any other packaging members. The filling of the cannulas, for example, and their transfer from the filling station (34) to the extraction station (36) are effected automatically by the invention. As each packaging member, for example cannula, is filled, the display (10) is incremented by one unit. The filled cannula is directly usable for inseminating turkeys, for example, in the context of an insemination operation. The liquid is ready for use, regardless of the type of application concerned (analysis, mixing, for example) and the packaging member used.

The dimensions given are given by way of illustration only. They are therefore not limiting on the invention. Nor is the invention limited to the embodiments shown and described in detail, since various modifications may be made to these without departing from the scope of the invention.

What is claimed is:

1. Automatic device for metering and filling volumes of animal semen, for example, in any form of packaging member regardless of their respective diameter and the material from which they are made, comprising a hopper (42) and a storage tank (43) containing the fluid to be metered and packaged, in this instance animal semen, characterized on the one hand in that it uses a compact system based on a peristaltic cassette (12) controlled by a digital controller and on the other hand in that it comprises two units; a unit (1) sealed against splashed and running liquids combining the controls and the operating logic of the device and a packaging member transfer and positioning device unit (2).

2. Device according to claim 1 characterized in that the front face (3) of the unit (1) sealed against splashed and running liquids combining the controls and the operating logic of the device includes an on/off switch (4); a button (5) for priming the peristaltic cassette (12); a button (6) for calibrating said peristaltic cassette (12); the two buttons (7) and (8) for adjusting the dose to be delivered; a digital display (9) for the calibration value of the peristaltic cassette (12) and for the volume of the dose to be dispensed; a digital display (10) for the number of packaging members, for example cannulas, filled; a clip-on base (11) for the peristaltic cassette (12); the peristaltic cassette (12); the clip-on base (13) of the filler needle (19); the needle unit (14) into which the filler needle (19) is inserted; the support (15) for fixing the packing member transfer and positioning device (2); the means (35) of driving the drum of said packaging member transfer and positioning device; the means (17) for driving the disentangling roller of the packaging member transfer and positioning device (2); the guide (19) for fitting the support for the needle unit (14) for the filler needle (19); the inductive sensor (20) controlling the packaging member, for example cannula, cycle (transfer of the cannula, filling, metering).

3. Device according to claim 2 characterized in that the inductive sensor (20) controlling the cannula, for example, cycle has a base (42) resting on the slide (30) for fixing the packaging member transfer and positioning device (2) in the demounted position.

4. Device according to claim 1 characterized in that the unit (1) sealed against splashed and running liquids houses a control printed circuit (21) for the peristaltic cassette (12); a dose and calibration display printed circuit (22); a device power supply and control printed circuit (23); a printed circuit (24) for the display of the number of packaging members filled, a direct current drive motor with no speed reducer and no brake; an incremental encoder for encoding the position of the peristaltic cassette (12); a gearmotor (27) for driving the disentangling roller (32) of the packaging member transfer and positioning device (2); an electromagnet (28) for driving the drum (35) of said packaging member transfer and positioning device (2); an electromagnet (29) for driving the filler needle (19); a position loop.

5. Device according to claim 4 characterized in that the number of packaging members filled is indicated on a light-emitting diode digital display (10).

6. Device according to claim 4 characterized in that on the one hand the calibration value of the peristaltic cassette (12) and on the other hand the volume of the dose to be dispensed are indicated on a light-emitting diode display (9).

7. Device according to claim 4 characterized in that the position loop is controlled by a microcontroller and for each of the doses delivered compares the number of encoder increments effected with the theoretical number of encoder increments.

8. Device according to claim 4 characterized in that the printed/circuit boards (21) and (23) are fixed by manually locked board guides.

9. Device according to claim 1 characterized in that the peristaltic cassette (12) can be mounted and demounted without tools using a clip-on system.

10. Device according to claim 1 characterized in that the peristaltic cassette (12) can be calibrated to suit the viscosity of the fluid to be metered and the characteristics of the feed tube (31).

11. Device according to claim 1 characterized so that the position of the peristaltic cassette (12) is controlled by a microcontroller.

12. Device according to claim 1 characterized in that the peristaltic cassette (12) is primed by manual action on a button (5), preferably a pushbutton.

13. Device according to claim 1 characterized in that the packaging member transfer and positioning device (2) comprises a slide (30) for fixing a cannula feed hopper (42), for example; a disentangling roller (32) for disentangling the packaging members, for example cannulas, a chute (33) for transferring cannulas, for example, from the hopper (42), for example, to the filling station (34); a drum (35) for transferring said cannulas, for example, from the filling station (34) to the extraction station (36); an orifice (37) for supporting the system for holding cannulas or other packaging members; a transparent cover (38) for protecting the cannula, for example, transfer area; a system (39) for locking the packaging member transfer and positioning device (2) to the unit (1) sealed against splashed and running liquids.

14. Device according to claim 13 characterized in that the packaging member transfer and positioning device (2) can be adapted to the configuration of the mode of packaging used (including cannulas, tubes, catheters, flasks, straws) and regardless of its diameter and the material from which it is made.

15. Device according to claim 13 characterized in that the support (15) for fixing the packaging member transfer and positioning device (2) can be equipped with a position return counterweight (40).

16. Device according to claim 1 characterized in that mounting and demounting the unit (14) in which a filling needle (19) is inserted does not unprime the peristaltic cassette (12).

17. Device according to claim 1 characterized in that the transfer—metering and filling of a packaging member cycle is commanded by the user upon removal of the filled cannula.

18. Device according to claim 1 characterized in that it may be associated with a plurality of peristaltic cassettes (12), rather than only one cassette, in order to carry out one or more multiple filling operations.

* * * * *